US006477932B2

(12) United States Patent
Jung

(10) Patent No.: US 6,477,932 B2
(45) Date of Patent: Nov. 12, 2002

(54) EXPLOSIVE-TRIGGERED RF BEAM SOURCE

(75) Inventor: Markus Jung, Eicklingen (DE)

(73) Assignee: Rheinmetall W & M GmbH, Unterluss (DE)

( * ) Notice: Subject to any disclaimer, the term of this patent is extended or adjusted under 35 U.S.C. 154(b) by 0 days.

(21) Appl. No.: 09/949,942

(22) Filed: Sep. 12, 2001

(65) Prior Publication Data

US 2002/0035918 A1 Mar. 28, 2002

(30) Foreign Application Priority Data

Sep. 12, 2000 (DE) ..... 100 44 867

(51) Int. Cl.[7] ..... F42B 12/36
(52) U.S. Cl. ..... 89/1.11
(58) Field of Search ..... 89/1.11; 102/214

(56) References Cited

U.S. PATENT DOCUMENTS

| | | | | |
|---|---|---|---|---|
| 3,594,791 A | * | 7/1971 | Pintell | |
| 3,922,968 A | * | 12/1975 | Conger et al. | |
| 4,972,757 A | * | 11/1990 | Nissl et al. | 89/8 |
| 5,125,104 A | * | 6/1992 | Ohkawa | 102/209 |
| 5,192,827 A | | 3/1993 | Jasper, Jr. | 89/1.11 |
| 5,216,695 A | | 6/1993 | Ross et al. | 343/820 |
| 5,307,079 A | | 4/1994 | Ross et al. | 343/822 |
| 5,707,452 A | | 1/1998 | Dandl | 427/575 |
| 5,975,014 A | | 11/1999 | Dandl | 427/569 |

FOREIGN PATENT DOCUMENTS

| | | | | |
|---|---|---|---|---|
| DE | 4141516 A1 | | 6/1992 | |
| DE | 19959358 A1 | | 6/2001 | |
| DE | 199 59 358 | | 6/2001 | |
| FR | 1.437.460 | * | 3/1966 | 89/1.11 |

OTHER PUBLICATIONS

Lindemuth I. R. et al., US/Russian Collaboration in High–Energy–Density Physics Using High–Explosive Pulsed Power: Ultrahigh Current Eexperiments, Ultrahigh Magnetic Field Applications, and Progress Toward Controlled Thermonuclear Fusion, IEE Transactions on Plasma Science, Dec. 1997, USA Bd. 25, Nr. 6, pp. / 1357–1372.

Engel T. G. et al., Design and Development of a Novel Flux Compression Generator for Landmine Detection Applications, 9th Symposium on Electromagnetic Launch Technology (EML), Edinburgh, UK, May 13–15, 1998; Bd. 35, Nr. 1, pt.1 pp. 245–249.

Database Inspec Online!, The Institution of Electrical Engineers, Fortov V E et al:, "Magnetic Flux Compressors For High Power Vircator System," accession no. 5124293; Database Inspec Online!.

Engel T. G. et al., Energy Conversion and High Power Pulse Production Using Miniature Magnetic Flux Compressors, IEEE Transactions on Plasma Science, Oct. 2000, IEEE, USA, Bd. 28, Nr. 5, pp. 1342–1346.

* cited by examiner

*Primary Examiner*—Stephen M. Johnson
(74) *Attorney, Agent, or Firm*—Venable; Norman N. Kunitz

(57) ABSTRACT

RF beam sources (HPM sources) serve in the non-lethal destruction, interference or screening of targets. An explosive-triggered RF beam source (2) constructed solely from a pulse-generation device (4), whose generated pulses are radiated directly at a target is provided. The pulse generator (4) is a magnetic flux compressor, and has a coil (6) that is filled with explosive material (10). A capacitive load ($C_L$) integrated into the RF beam source (2) is connected on the output side to the pulse-generator (4), and forms an electrical resonating circuit with the coil (6) and simultaneously functions as an antenna. Preferably, an element (14) is mounted in the region (13) between the coil body (6.1) and the windings (6.2) to increase the number of free electrons for supporting the plasma formation and attaining a higher conversion of chemical energy into electrical energy, and therefore inducing a higher frequency.

15 Claims, 2 Drawing Sheets

EXPLOSIVE-TRIGGERED RF BEAM SOURCE

CROSS REFERENCE TO RELATED APPLICATION

This application claims the priority of German patent Application No. 100 44 867.4 filed Sep. 12, 2000, which is incorporated herein by reference.

BACKGROUND OF THE INVENTION

The invention relates to an explosive-triggered RF beam source, having a pulse-generation device with a coil, which includes a liner and windings, an explosive material located in the liner, and a fuze for igniting the explosive material.

RF (Radio Frequency) beam sources, also referred to as HPM (High Power Microwave) sources, are known for the non-lethal destruction, interference or screening of targets. For these purposes, the RF beam sources can be accommodated in a carrier system, such as a warhead.

U.S. Pat. No. 5,192,827 describes an RF beam source in a projectile. The current required to generate a high emission frequency is stored in a pulse-shaping device prior to the firing of the projectile. The pulse-shaping device is formed by a coil, a dielectric rod and a dielectric material. The pulse-shaping device is discharged via a nanosecond switch. By way of this switch, the generated pulse is fed into an antenna located in the projectile, which radiates the pulse through the projectile housing and toward the target. In one exemplary embodiment, a plurality of pulse-shaping devices is disposed in the projectile. The total attainable power is about 12 MW.

U.S. Pat. No. 5,707,452 describes an electron-accelerated microwave applicator for a plasma source. Here, the high energy is realized through the acceleration of the generated plasma electrons as they pass gaps of the slotted applicator, which is electrically connected to an antenna. U.S. Pat. No. 5,975,014, which ensues from the above-cited U.S. Pat. No. 5,707,452, also describes an applicator of this nature.

DE 41 41 516 A1 describes an electrical pulse generator having a saturatable inductive reactance. To shape pulses, a coaxial line is loaded through a magnetic compression, and relieved via a magnetic switch having a saturatable inductive reactance, which shapes pulses.

U.S. Pat. No. 5,307,079 and U.S. Pat. No. 5,216,695 disclose circuits that generate and amplify microwaves. Transistors that transmit the microwaves to an antenna are integrated into a Marx generator for attaining high frequencies.

German patent reference DE 199 59 358 discloses an autonomous RF beam source that is triggered by an explosive material. Here, a fuse of a magnetic flux compressor is ignited by a battery, with time or impact control, and the highly-explosive material located in the liner ruptures the coil body in a conventional manner, whereby the individual windings are short-circuited consecutively. On the output side, the flux compressor is connected to an amplifier unit, which amplifies the generated voltage and transmits it to a UWB chopper via a high-pressure spark gap for generating pulses. The pulses are then radiated at the target by way of a broadband antenna that is adapted with the cable resistance of the UWB pulse.

SUMMARY OF THE INVENTION

It is the object of the invention, to provide a simple, explosive-triggered RF beam souse that simultaneously permits an increase in the high frequency and is able to radiate.

The above object generally is accomplished according to the present invention by an explosive-triggered RF beam source, having a pulse-generation device with a coil, which includes a liner and windings, and with an explosive material located in the liner and ignited by a fuze; and wherein an element that supports plasma formation is disposed in a region between the coil body and the liner, and the pulse-generation device is connected on the output side to a capacitive load functioning as an antenna, and/or an inductive load.

The concept underlying the invention is to construct an explosive-triggered RF beam source solely from a pulse generator or a pulse-generation device whose generated pulses are radiated directly at a target. The pulse generator is embodied as a magnetic flux compressor, and has a liner that is filled with an explosive material and is located in a coil. A capacitive load that is connected on the output side to the pulse generator is integrated into the RF beam source; the coil thereby forms an electrical resonating circuit with the capacitive load, and the capacitive load simultaneously functions as an antenna. The frequency generated in this resonating circuit can therefore be radiated directly. For this purpose, the housing of the RF beam source must be configured such that the generated frequencies can pass through it unimpeded. Furthermore, an element for increasing the power of the RF beam source is mounted in the region between the liner in the coil and the windings, which increases the number of free electrons for supporting the plasma formation and attaining a better conversion of chemical energy into high-frequency energy in order to induce a higher frequency.

Materials having a low electrical conductivity, a low bonding energy for electrons and rough surface structures with material peaks in the range of a few micrometers ($\mu$m) are suitable as means for forming a plasma.

A further option for increasing plasma formation is to increase the electrical field intensity in the region between the coil and the explosive-triggered short-circuit device with a corresponding embodiment of the coil structure.

The generation of a vacuum for reducing the ambient pressure where the liner opens in the region between the coil and the explosive-triggered short-circuit device likewise has a positive effect on the formation of free electrons.

Moreover, a background gas that is beneficial for plasma formation can be introduced into the region between the coil and the explosive-triggered short-circuit device.

The invention is described in detail by way of exemplary embodiments.

DETAILED DESCRIPTION OF THE PREFERRED EMBODIMENTS

Figure 1:
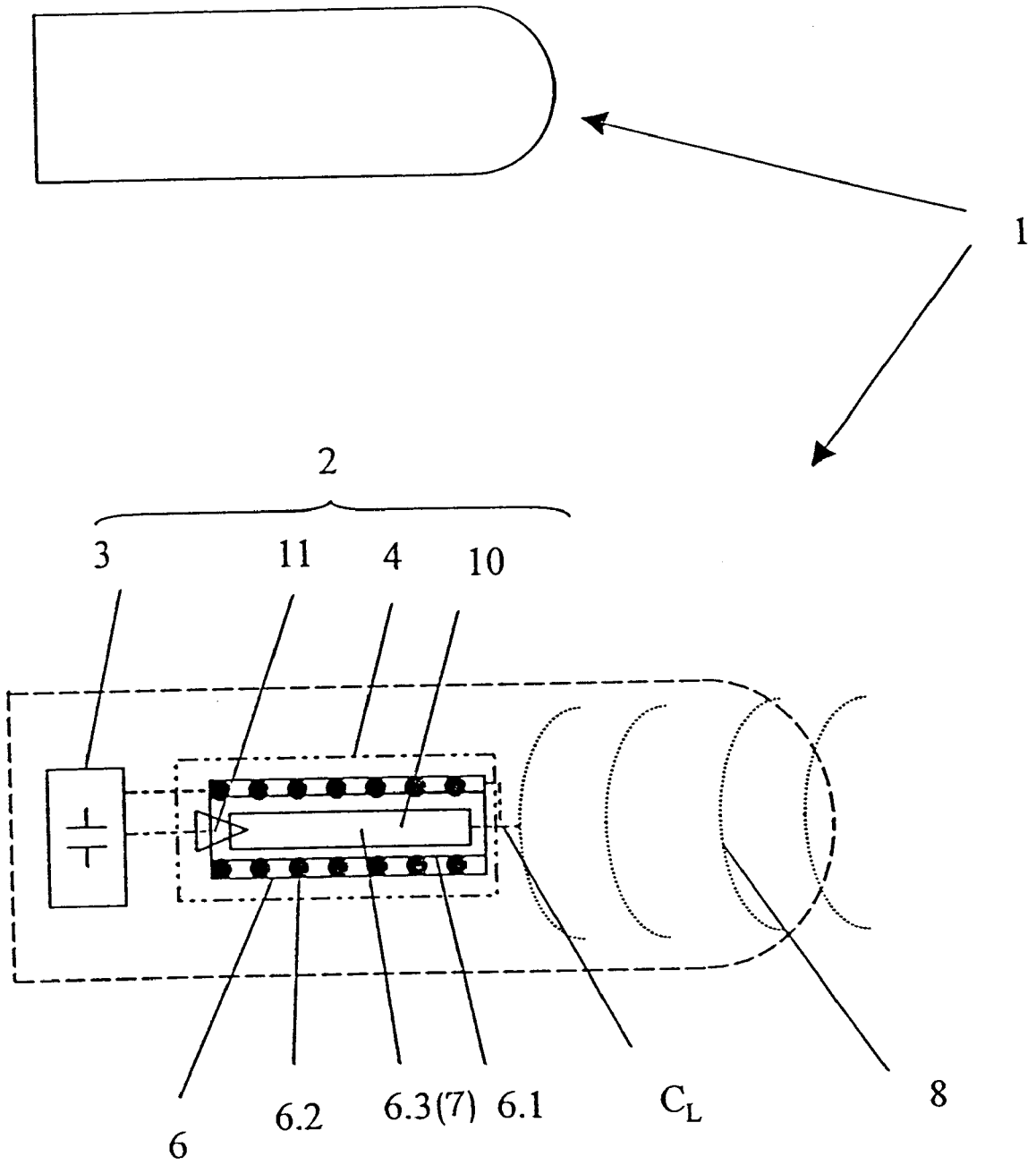
FIG. 1 shows an RF beam source in a carrier system.

FIG. 1 depicts a carrier system 1, here a projectile, for accommodating an RF beam source 2. The RF beam source 2 comprises a battery 3 or a similar electrical energy-storage unit that is in an electrical connection with a fuze 11 of a pulse-generation device 4 that is operated with an explosive material 10, as well as a capacitive load $C_L$. The capacitive load $C_L$ is connected to the output of a pulse-generation device 4. In this case, the pulse-generation device 4 is a magnetic flux compressor having a coil 6 that comprises a coil body 6.1, on which windings 6.2 are located, and into which a liner 6.3 is integrated. The connection to the battery or the on-switch of the battery initiates a current flow in the windings 6.2. The explosive material 10 and the fuze 11 are accommodated either in a short-circuit device 7 that is additionally integrated into the coil 6, or in the liner 6.3.

The general operating principle of this RF beam source 2 can be described as follows:

The autonomous RF beam source 2 is brought to the target on-site with the carrier system 1. There, the battery 3 is connected to the coil 6, possibly with time or impact control. When the current maximum has been attained in the coil 6, a further energy supply, not shown, ignites the fuze 11, e.g., an annular fuse, of the magnetic flux compressor 4. In the process, the highly-explosive material 10 located in the short-circuit device 7 or in the opening liner 6.3, ruptures the short-circuit device 7 and the coil body 6.1 in a conventional manner, and the individual windings 6.2 are short-circuited consecutively. If the initial inductance is small, and the magnetic flux is constant, an amplification of almost 100 times or more is still effected with only one winding 6.2. Chemical energy is converted into electrical energy, with the end energy W being dependent on the initial inductance $L_0$/end inductance $L_n$ x initial energy $W_0$.

After the current circuit has been closed and the liner 6.3 has opened, the capacitive load $C_L$ and the coil 6 form a resonating circuit whose frequency changes due to the temporal change in the inductance of the coil 6 based on the shock wave in the liner 6.3. This frequency, or the generated pulse 8, is radiated directly from the capacitive load $C_L$ functioning as an antenna.

Figure 2:
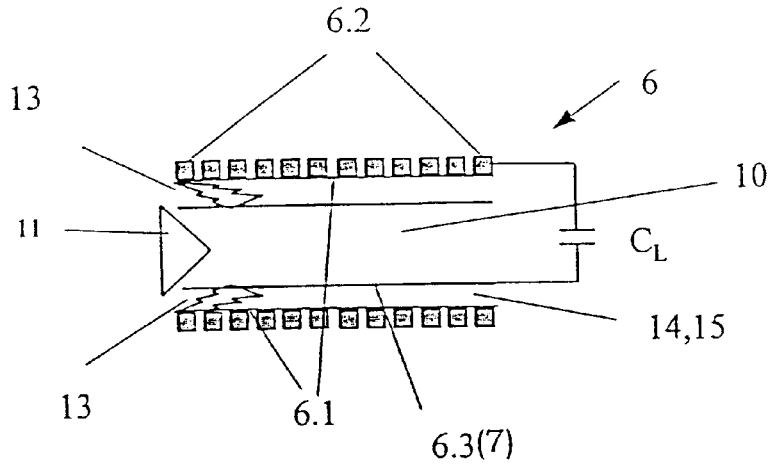
FIG. 2 illustrates a first embodiment of the RF beam source according to the invention.
Figure 3:
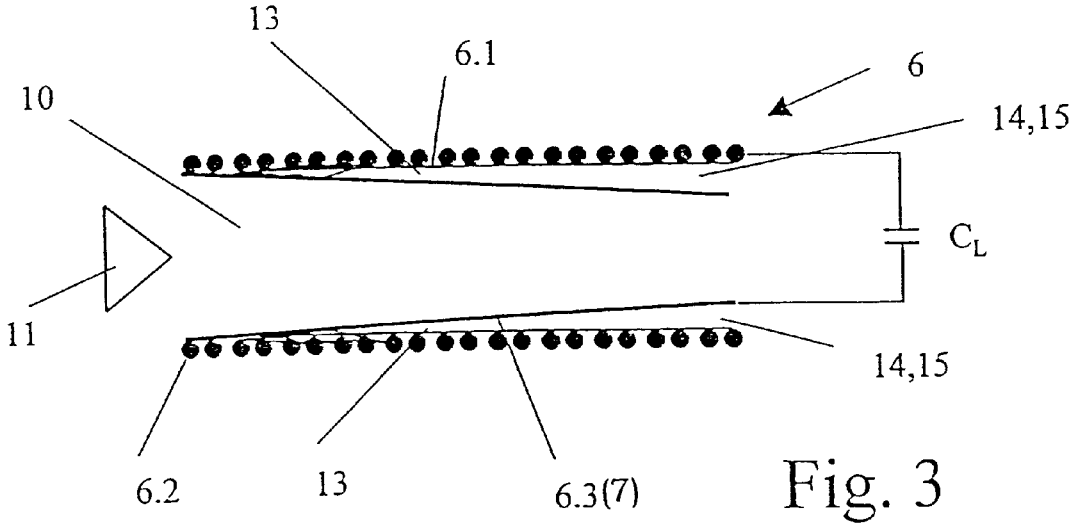
FIG. 3 illustrates a further embodiment of the RF beam source according to the invention.

To increase the frequencies that can be radiated, FIGS. 2 and 3 show structural changes to the magnetic flux compressor 4 to obtain a plurality of free electrons. This effects a spontaneous plasma formation with an extremely-fast switch-on behavior, so higher frequencies can be generated without additional electrical components.

FIG. 2 shows a first variation, in which an element 14 that supports the plasma formation is mounted between the coil body 6.1 with its windings 6.2 and the liner 6.3.

This supportive element 14 can be, on the one hand, a material 15 that is positioned as a layer between the coil body 6.1 and the liner 6.3, or, on the other hand, a beneficial background gas or a vacuum, in which case it is possible to combine the layer and the gas or vacuum.

A material 15 that increases plasma formation has a low electrical conductivity, a low bonding energy for electrons, and/or a surface structure that has material peaks in the range of a few micrometers. An example of a material 15 that possesses all of these features for increasing the number of free electrons is a carbon fiber or velvet.

FIG. 3 illustrates a further measure for increasing the electrical field intensity in the region 13, which likewise positively influences the plasma formation. Here, the coil cross-section of the coil 6 has been altered: The coil body 6.1 has a frustoconical shape, and its larger coil cross-section already reaches the first windings 6.2 of the coil 6. A sharp edge is formed between the short-circuit device 7 or the liner 6.3, and the coil body 6.1 with the first winding 6.2, i.e., at the input end of the pulse-generator. The energy required for the short-circuit that ruptures the short-circuit device and the coil body 6.1 can be minimized, and therefore be available for the plasma formation, depending on the smaller necessary path between the short-circuit device 7 or liner 6.3 and the windings 6.2.

Figure 4:
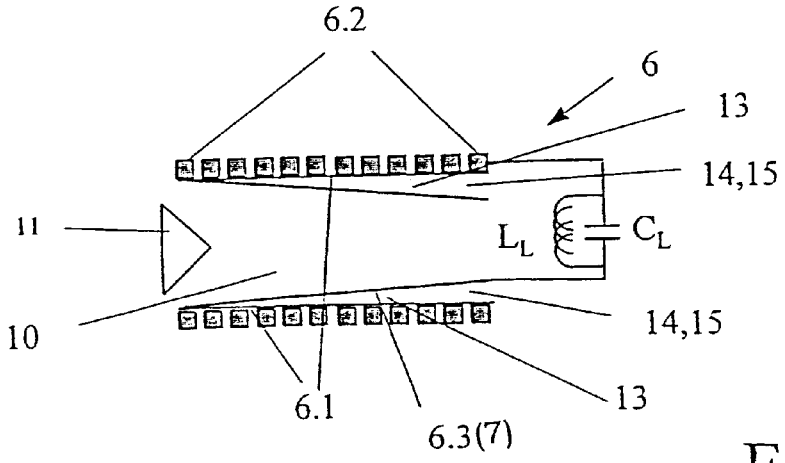
FIG. 4 illustrates a parallel resonating circuit as a load.

As a variation of the capacitive load $C_L$, an LC parallel resonating circuit can also be connected on the output side to the pulse-generation device 4, as shown in FIG. 4. This improves the radiation characteristic of the RF beam source 2.

Of course, modifications are possible within the spirit of the inventive concept. For example, the described RF beam source 2 can also be combined with conventional amplifying devices and antennas.

The invention now being fully described, it will be apparent to one of ordinary skill in the art that many changes and modifications can be made thereto without departing from the spirit or scope of the invention as set forth herein.

What is claimed is:

1. An explosive-triggered RF beam source, comprising a pulse-generation device including a coil, having a coil liner and a coil body with windings disposed about the liner, an explosive material located in the liner; a fuze for igniting the explosive at one end of the liner adjacent an input of the pulse-generation device to cause consecutive short circuiting of the coil windings; a voltage source for selective connection to the coil; an element that supports plasma formation disposed in a region between the coil body and the liner; and an electrical reactive load connected on the output side of the pulse-generation device and functioning as an antenna.

2. The explosive-triggered RF beam source according to claim 1, wherein the load is a capacitive load, which act as an antenna.

3. The explosive-triggered RF beam source according to claim 1, wherein the plasma formation comprises a material that is mounted on the surface of the coil body and has at least one of a poor electrical conductivity, a poor bonding energy for electrons and a rough surface structure.

4. The explosive-triggered RF beam source according to claim 3, wherein the material comprises carbon fibers.

5. The explosive-triggered RF beam source according to claim 3, wherein the material is velvet.

6. The explosive-triggered RF beam source according to claim 1, wherein the plasma supporting element has a conical coil cross-section.

7. The explosive-triggered RF beam source according to claim 6, wherein the conical cross-section of the plasma-supporting element is greatest at said one input end of the liner.

8. The explosive-triggered RF beam source according to claim 7, wherein the supporting element further includes a background gas.

9. The explosive-triggered RF beam source according to claim 8, wherein the background gas is helium or argon.

10. The explosive-triggered RF beam source according to claim 7, wherein the plasma supporting element further includes a vacuum.

11. The explosive-triggered RF beam source according to claim 1, wherein the supporting element includes a background gas.

12. The explosive-triggered RF beam source according to claim 11, wherein the background gas is helium or argon.

13. The explosive-triggered RF beam source according to claim 1, wherein the plasma supporting element is a vacuum.

14. The explosive-triggered RF beam source according claim 1, wherein the reactive load comprises a capacitor ($C_L$) and a coil ($L_L$) electrically connected as a parallel resonating circuit to the pulse-generation device.

15. The explosive-triggered RF beam source according to claim 1, wherein the load is an inductive load, which acts as an antenna.

* * * * *